US007959856B2

(12) United States Patent
Ikuno et al.

(10) Patent No.: US 7,959,856 B2
(45) Date of Patent: Jun. 14, 2011

(54) ALUMINUM ALLOYS FOR CASTING AND ALUMINUM ALLOY CASTINGS

(75) Inventors: Hajime Ikuno, Owariasahi (JP); Hiroshi Hohjo, Nagoya (JP); Yoshihiko Sugimoto, Nagoya (JP); Isamu Ueda, Kasugai (JP); Hiroaki Iwahori, Aichi-ken (JP)

(73) Assignee: Kabushiki Kaisha Toyota Chuo Kenkyusho, Aichi-ken (JP)

( * ) Notice: Subject to any disclaimer, the term of this patent is extended or adjusted under 35 U.S.C. 154(b) by 0 days.

(21) Appl. No.: 10/965,293

(22) Filed: Oct. 14, 2004

(65) Prior Publication Data

US 2005/0100473 A1 May 12, 2005

(30) Foreign Application Priority Data

Oct. 17, 2003 (JP) ..... 2003-358149

(51) Int. Cl.
*C22C 21/04* (2006.01)

(52) U.S. Cl. ..... 420/544; 420/549; 420/551

(58) Field of Classification Search ..... 420/544, 420/548, 549, 551
See application file for complete search history.

(56) References Cited

U.S. PATENT DOCUMENTS

| | | | | |
|---|---|---|---|---|
| 5,023,051 | A * | 6/1991 | Lindberg | 420/549 |
| 5,523,050 | A * | 6/1996 | Lloyd et al. | 420/528 |
| 6,511,555 | B2 * | 1/2003 | Feikus et al. | 148/417 |
| 2003/0143102 | A1 * | 7/2003 | Matsuoka et al. | 420/546 |
| 2004/0265163 | A1 * | 12/2004 | Doty | 420/548 |

FOREIGN PATENT DOCUMENTS

| | | | |
|---|---|---|---|
| DE | 199 25 666 | C1 | 9/2000 |
| DE | 10206035 | A1 * | 8/2003 |
| EP | 0 861 911 | A1 | 9/1998 |
| EP | 1 340 827 | A1 | 9/2003 |
| FR | 2 832 913 | A | 6/2003 |
| JP | 10-251790 | | 9/1998 |
| JP | 11-199960 | | 7/1999 |
| JP | 3164587 | B2 | 3/2001 |
| JP | 2001-303163 | | 10/2001 |
| JP | 3415346 | B2 | 4/2003 |
| WO | WO-98/10109 | A1 | 3/1998 |

(Continued)

OTHER PUBLICATIONS

"Aluminum and Aluminum Alloys", ASM International, 1993, p. 90, 93.*
"Aluminum and Aluminum Alloys", ASM International, 1993, p. 532-533.*
"Aluminum and Aluminum Alloys", ASM International, 1993, p. 555.*

(Continued)

*Primary Examiner* — Roy King
*Assistant Examiner* — Janelle Morillo
(74) *Attorney, Agent, or Firm* — Leason Ellis LLP.

(57) ABSTRACT

Aluminum alloys and castings are provided that have excellent practical fatigue resistances. The alloy includes, based upon 100 mass %, 4-12 mass % of Si, less than 0.2 mass % of Cu, 0.1-0.5 mass % of Mg, 0.2-3.0 mass % of Ni, 0.1-0.7 mass % of Fe, 0.15-0.3 mass % of Ti, and the balance of aluminum (Al) and impurities. The alloy has a metallographic structure, which includes a matrix phase primarily of α-Al and a skeleton phase crystallizing around the matrix phase in a network shape. The matrix phase is strengthened by precipitates containing Mg. Because of the strengthened matrix phase, and the skeleton phase that surrounds it, the castings have high strength, high fatigue strength, and high thermo-mechanical fatigue resistance.

8 Claims, 2 Drawing Sheets

FOREIGN PATENT DOCUMENTS

| | | | |
|---|---|---|---|
| WO | WO 0071772 | A1 * | 11/2000 |
| WO | WO-03/047404 | | 6/2003 |
| WO | WO 03047404 | A1 * | 6/2003 |

OTHER PUBLICATIONS

"Classification Handbook: Classification Definitions", Oct. 2007, p. 420-7.*

European Search Report for EP 04 02 3942 mailed Mar. 18, 2005.

Patent Abstracts of Japan for JP2001-303163 published Oct. 31, 2001.

Patent Abstracts of Japan for JP11-199960 published Jul. 27, 1999.

Patent Abstracts of Japan for JP10-251790 published on Sep. 22, 1998.

Patent Abstracts of Japan for JP11-199960 published on Jul. 27, 1999.

Patent Abstracts of Japan for JP2001-303163 published on Oct. 31, 2001.

Patent Abstracts of Japan for JP09-087530 published on Mar. 31, 1997.

* cited by examiner

10MM

Cu: 0 mass %

10MM

Cu: 0.5 mass%

10MM

Cu: 5 mass%

ALUMINUM ALLOYS FOR CASTING AND ALUMINUM ALLOY CASTINGS

INCORPORATION BY REFERENCE

The present application claims priority under 35 U.S.C. §119 to Japanese Patent Application No. 2003-358149 filed on Oct. 17, 2003. The content of the application is incorporated herein by reference in its entirety.

FIELD OF THE INVENTION

The present invention relates to aluminum alloy castings with excellent practical fatigue resistance such as high cycle fatigue strength, and thermo-mechanical fatigue resistance, their manufacturing method, and aluminum alloys for casting suited for the manufacturing.

DESCRIPTION OF THE RELATED ART

An increasing number of automobile components are being made of aluminum alloys as a result of the weight reduction demand. Even the components which are already made of aluminum are being required to be made thinner to reduce their weights. Consequently, higher reliability is demanded for aluminum alloys in terms of strength and fatigue resistance. In particular, aluminum alloys used for automobile engine components are demanded to have superior fatigue resistance (thermo-mechanical fatigue resistance) that can withstand hot/cold cycles, not just high temperature strength and creep resistance, as they are often used under high temperature environments. A typical component such as that is the cylinder head of the reciprocating engine.

Since cylinder heads have complex shape and large size, they are normally produced by the casting process. Various aluminum alloys have been developed including AC2A, AC2B, AC4B, and AC4C (JIS), and are disclosed in Japanese Laid-Open Patent Publication Nos. H10-251790, H11-199960, 2001-303163, Japanese Patent Publication Nos. 3415346 and 3164587 (JP '587). Most of the aluminum alloys of the embodiments of the above documents use Cu and Mg. Cu and Mg are used as they contribute to strengthening of the cylinder head through strengthening of the matrix phase by precipitation hardening. On the other hand, JP '587 shows a case where Cu and Mg are treated as impurities, keeping their amounts below 0.2 mass %. This is because Cu and Mg develop thermally unstable precipitates, and the precipitates grow coarser during the use of the casting, thus deteriorating its ductility and toughness and reducing the thermo-mechanical fatigue resistance as a result.

SUMMARY OF THE INVENTION

The aluminum alloy of JP '587 tends to have extremely low hardness and strength due to the fact that it essentially lacks Cu and Mg and the practical strength and other characteristics of the alloy as the base metal tend to be insufficient. Therefore, JP '587 shows a method of using a separate high strength aluminum alloy for casting and overlaying the base metal with it by welding in areas where high thermo-mechanical fatigue resistance is required because of thermal stress concentration (e.g., valve bridges and areas between the auxiliary combustion chamber hole and valve holes of a cylinder head). In other words, the aluminum alloy disclosed in JP '587 has only limited use in the area where high thermo-mechanical fatigue resistance is required. Using different aluminum castings in the different areas, such as this, is undesirable as it increases the manufacturing cost of castings such as cylinder heads sharply.

The object of the present invention is to solve these problems by providing aluminum alloys having strength and fatigue resistance required for castings such as cylinder heads, and excellent thermo-mechanical fatigue resistance. Another object of the invention is to provide such aluminum alloy castings and their manufacturing method.

The inventor strived to solve the problems and found a way to improve the strength and fatigue resistance of the base metal and achieve high thermo-mechanical fatigue resistance at the same time, not necessarily reducing the ductility and toughness of the casting when Mg is included to strengthen the casting as a whole.

Aluminum alloys for castings—The aluminum alloys for casting with excellent practical fatigue resistance according to an embodiment of the invention include: in 100 mass %, 4-12 mass % of silicon (Si), less than 0.2 mass % of copper (Cu), 0.1-0.5 mass % of magnesium (Mg), 0.2-3.0 mass % of nickel (Ni), 0.1-0.7 mass % of iron (Fe), 0.15-0.3 mass % of titanium (Ti), and the remainder essentially Aluminum (Al) (generally about 81-95 mass %) and inevitable impurities (generally in amounts up to about 0.5 mass %). More preferably, Al may be about 86.5-93.6 mass %. And still more preferably, Al may be about 88.4%-91.2 mass %. The inevitable impurities may be preferably less than about 0.25 mass %. And still more preferably, the impurities may be less than about 0.1 mass %.

The aluminum alloy castings produced using the aluminum alloys according to this invention have high strength and high fatigue strengths (fatigue resistances) as well as high thermo-mechanical fatigue resistances. The use of these aluminum alloys for castings makes it possible to cast a whole casting with a single alloy, thus substantially reducing the manufacturing cost, even when a casting requires not only a high strength throughout the casting but also a high local thermo-mechanical fatigue strength, as in the case of a cylinder head. For example, the aluminum alloys for casting according to the present invention are most suitable for casting high performance gasoline engine cylinder heads or diesel engines cylinder heads that require high strengths and high fatigue resistances.

Aluminum alloy castings—The present invention includes not only aluminum alloys for casting but also aluminum alloy castings with excellent practical fatigue resistances. The invention provides aluminum alloy castings with excellent practical fatigue resistances that include: in 100 mass %, 4-12 mass % of silicon (Si), less than 0.2 mass % of copper (Cu), 0.1-0.5 mass % of magnesium (Mg), 0.2-3.0 mass % of nickel (Ni), 0.1-0.7 mass % of iron (Fe), 0.15-0.3 mass % of titanium (Ti), and the remainder of Aluminum (Al) and inevitable impurities.

Method of manufacturing aluminum alloy castings—The present invention further includes a suitable method for producing aluminum alloys for casting. The invention includes: a casting process for obtaining aluminum castings by pouring molten aluminum alloy mainly of Al into a mold; and a heating process of solution heat treatment and aging heat treatment applied to said aluminum alloy castings; wherein said aluminum alloy castings after said heating process includes in 100 mass %, 4-12 mass % of silicon (Si), less than 0.2 mass % of copper (Cu), 0.1-0.5 mass % of magnesium (Mg), 0.2-3.0 mass % of nickel (Ni), 0.1-0.7 mass % of iron (Fe), 0.15-0.3 mass % of titanium (Ti), and the remainder of aluminum (Al) and inevitable impurities, and said castings have excellent practical fatigue resistances as their metallographic structures are a matrix phase primarily of α-Al and a skeleton phase crystallizing around said matrix phase in a network shape, wherein said matrix phase is strengthened by precipitates containing Mg.

The aluminum alloy according to the present invention is capable of achieving both high strength or high fatigue strength and high thermo-mechanical fatigue resistance simultaneously, which has hitherto been difficult to achieve. While it is not quite clear how it is achieved, it is theorized as follows. (Both aluminum alloys for casting and aluminum alloy castings, the latter being casting products, will be collectively called as "aluminum alloys" for convenience wherever it is applicable.)

The conventional thought about increasing the fatigue strength of an aluminum alloy (casting) has been to try to increase its static tensile strength. The traditional approach has been to include precipitation strengthening elements such as Cu and Mg.

However, a simple application of such an approach may be able to achieve an increase of the strength of the aluminum alloy, but it also causes reductions of ductility and toughness. Consequently, not only it is incapable of increasing the fatigue strength, which is affected by stress concentrations and the average stress, but also it invites the reduction of the thermo-mechanical fatigue resistance because of the reduction of its ductility and toughness. Thus, it has hitherto been extremely difficult to achieve high levels of strength, fatigue resistance, and thermo-mechanical fatigue resistance simultaneously in aluminum alloys. For example, none of the references mentioned above satisfy all of these characteristics simultaneously at high levels; they only achieve some of these characteristics.

On the other hand, the aluminum alloys according to the present invention achieve high levels of strength, fatigue resistance, and thermo-mechanical fatigue resistance simultaneously by optimizing the contents of Mg as well as Ni, Fe and Ti, without essentially containing Cu. The action of each ingredient will be discussed below.

First of all, since the aluminum alloys according to the invention do not essentially contain Cu, the structure of the matrix phase is stable and prevents the matrix phase from becoming brittle, which contributes to the improvement of the thermo-mechanical fatigue resistance. Incidentally, the matrix becomes brittle because of Cu when Cu compounds precipitated in the matrix grow to form coarse precipitates under a thermo-mechanical fatigue environment.

However since the aluminum alloys according to the invention do not essentially contain Cu, strengthening of the material by Cu precipitates cannot be expected. Therefore, the inventors strengthen the aluminum alloys by adding Mg. Another reason for choosing Mg instead of Cu was the consideration of their respective corrosion resistances.

It is expected that the inclusion of Mg in the aluminum alloys to the same level as in the prior art causes the deterioration of fatigue strength and thermo-mechanical fatigue resistance due to the reduction of the ductility and toughness of the aluminum alloys, even though higher strengths of the base metal can be achieved. However, the present inventors, after intensive research, found a way to increase the hardness, strength, fatigue strength, and the like of aluminum alloys with very little effect on thermo-mechanical fatigue resistance by controlling the Mg content within the limitations of the invention. Of course, it is expected that the ductility and toughness reduction of the aluminum alloys will affect the fatigue strength and thermo-mechanical fatigue resistance, even though slightly, due to the deteriorations of the ductility and toughness of the aluminum alloys when the Mg content is increased. However, it is considered that such deteriorations can be sufficiently compensated for by the strengthening of the skeleton phase by the compounds of Ni, Fe, etc. In particular, an appropriate adjustment of the Ni content makes it possible to achieve high thermo-mechanical fatigue resistance equal to or even higher than the level achieved by the aluminum alloys of the prior art. This will be described further in the following.

The skeleton phase spreads out like a network surrounding the matrix phase. The stresses and strains applied to the alloys tend to be distributed evenly throughout the alloys without concentrating, due to the skeleton phase. As the crystallization amounts of Ni compounds and Fe compounds increase in the skeleton phase, the stress concentration tends to occur more easily in those areas, increasing the probability of causing a deterioration of the fatigue strength of the aluminum alloys, as well. However, since Cu is not contained essentially in the aluminum alloys according to the present invention, the matrix remains relatively soft, and the Mg content is limited, so that the stress concentrations in the areas where crystallization of Ni compounds and Fe compounds occur do not cause any serious problems.

The aluminum alloys of the present invention also contain Ti. This makes the grain size of the aluminum alloys extremely fine. As a consequence, the distribution of the skeleton phase of the aluminum alloys tends to be isotropic, which makes the applied stresses and strains spread more uniformly, thus contributing to the improvements of fatigue strength and thermo-mechanical fatigue resistance. Moreover, Ti is solid-soluted into the matrix, strengthening the matrix with the solid solution, which is also effective in improving strength of the aluminum alloys. Thus, it is believed that the aluminum alloys of the present invention can achieve high levels of strength, fatigue strength and thermo-mechanical fatigue resistance, which has hitherto been impossible to achieve, by only the optimizing the contents of various alloy elements and their synergistic actions.

The aluminum alloy castings according to the present invention may experience some changes in structure in the very early stage of their usages. For example, as in the case of cylinder heads, there are differences in their thermal environments depending on locations, and the temperatures in some parts in the vicinities of the cylinder heads combustion chambers can be relatively high, causing Mg compounds precipitated from the matrix to grow coarser in the early stages of usage. However, the growth of coarser precipitates ceases in the early stages, and further heating recovers ductility and toughness in the present invention. Moreover, even if ductility and toughness deteriorate in an early stage of usage, that rarely affects the thermo-mechanical fatigue resistance as the skeleton phase strengthened by Ni compounds and others is supporting the matrix. On the other hand, the matrix in the areas of a cylinder head which are not exposed to high temperature is strengthened by the precipitates of Mg compounds so that the matrix maintains sufficient strength and hardness as the base metal. As such, even though different characteristics are demanded depending on the locations of the member, the aluminum alloys according to the invention can satisfy all of those demands simultaneously.

The term "strength" used herein means the fracture strength in the early stage of usage of the aluminum alloy. This strength is maintained approximately within the temperature range of room temperature to 150° C. The strength can be expressed in terms of tensile strength, but can also be expressed by the overall hardness of the alloy. Additionally, the tensile strength is generally high when the fatigue strength (to be described later) is high.

The term "fatigue" used herein means the strength against high cycle fatigue in general, while the term "fatigue strength" means the resistance against said fatigue. "Fatigue strength" is the fracture strength when a repetitive stress is applied to the aluminum alloy castings at a specified temperature. It is expressed in terms of average stress, stress amplitude, and repetitive cycles (life until a fracture occurs).

The term "thermo-mechanical fatigue" used herein means a kind of low cycle fatigue, which occurs when a temperature and a strain change cyclically, and the term "thermo-mechanical fatigue resistance" means the resistance against said fatigue. The thermo-mechanical fatigue means, more specifically, a fatigue which occurs as a result of strains in the tensile direction or the compressive direction caused during a heating period as well as strains in the tensile direction or the compression direction caused during a cooling period due to constraints of thermal expansion and thermal contraction. The thermo-mechanical fatigues can be either out-of-phase or in-phase depending on the phase difference of temperature and strain. This thermo-mechanical fatigue is expressed in terms of thermo-mechanical fatigue life. The testing method for these will be discussed later. Since the thermal expansion coefficient of an aluminum alloy is generally high, out-of-phase thermal fatigue is likely to occur due to compressive strains during heating and tensile strains during cooling caused by the constraints of thermal expansion. The fatigue strength and the thermo-mechanical fatigue resistance are herein collectively called as "practical fatigue resistances."

PREFERRED EMBODIMENT

Figure 1:
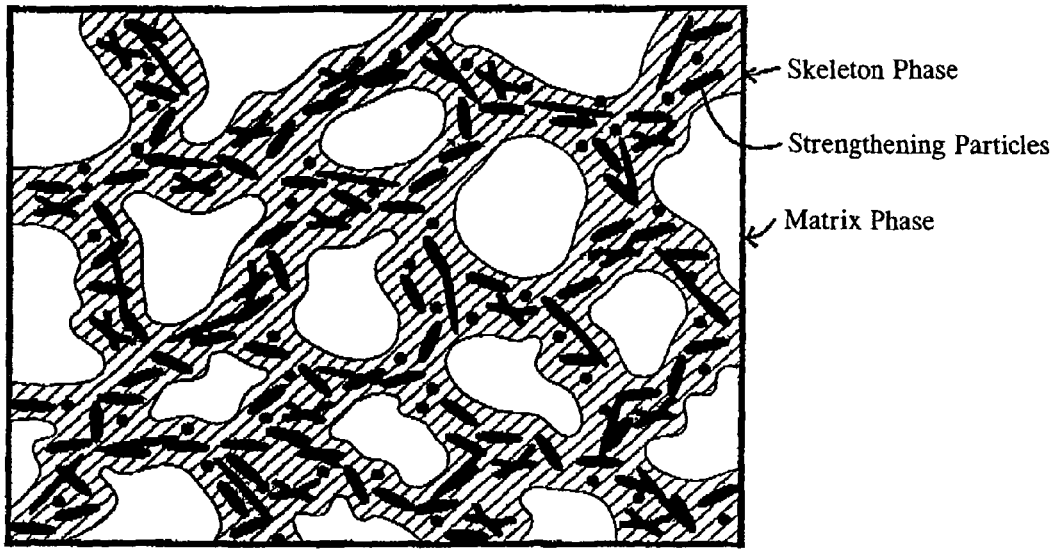
FIG. 1 is a schematic drawing showing the metallurgical structure of the aluminum alloy casting according to the invention.

The present invention will be described in more detail using preferred embodiments. The invention being described in this specification, including the embodiments, can be applied equally to all aluminum alloys for castings, aluminum alloy castings, and their manufacture according to the present invention. Which embodiment format is most suitable depends on the object to be cast, its required performance, etc.

(1) Composition

The Si content of the aluminum alloys according to the present invention should preferably be 4-12 mass %. If the Si content is less than 4 mass %, a poor castability results and casting defects tend to occur. Also, lower Si content results in a higher thermal expansion coefficient. On the other hand, if the Si content exceeds 12 mass %, a stronger orientation results when the molten alloy solidifies, causing the metal structure to be heterogeneous. It also may cause a large amount of casting defects in the areas where solidification occurs last. Moreover, brittle Si particles may increase which will lower the ductility and toughness of the casting.

A Si content of 5-9 mass % is most preferable. If the Si content is within this range, castability becomes most stable. The amount of eutectic Si that constitutes the skeleton phase also becomes most suitable to provide aluminum alloy castings with excellent strength and ductility. Moreover, the optimum range of Si content is 7-8 mass %. This range of Si content provides further stability in casting and the best balance of ductility and strength.

The most suitable Cu content is less than 0.2 mass %. If the Cu content exceeds 0.2 mass %, a large amount of thermally unstable precipitates will be generated in the alloys in high temperature ranges where cylinder heads are used. Those precipitates gradually become coarse during the use of the aluminum alloy castings, bring about deterioration of the ductility and toughness, and may cause a severe reduction of the thermo-mechanical fatigue resistance of the aluminum alloy castings. Also, if the Cu content exceeds 0.2 mass %, the matrix phase becomes excessively hard due to the precipitation strengthening action. Particularly, when the amount of crystallizations is higher as in the case of the aluminum alloys of the invention, there is a concern that a deterioration of fatigue strength may occur due to stress concentrations. Thus, the smaller the Cu content is, the better, and its upper limit should preferably be 0.1 mass % or most preferably be 0.05 mass %. The best practice, therefore, is to choose a Cu content of 0 mass %, allowing Cu to exist only as an inevitable impurities.

The declining tendency of the thermo-mechanical fatigue resistance due to the deteriorations of ductility and toughness as mentioned above occurs not only with Cu but also with Mg to a degree. However, if it is a small amount of Mg, it causes only a limited amount of coarsening of the precipitates in the early stage and the structural changes due to heating later will be kept to a minimum, restoring ductility and toughness quickly. Cu has a strong tendency to cause the aluminum alloys to corrode. Therefore, the Cu content should be kept to the range shown above from the corrosion prevention standpoint, as well. However, there is a possibility that Cu may exist in the aluminum alloys as impurities considering material recycling, manufacturing cost, etc. Therefore, the upper limit of the Cu content is set to 0.2 mass % rather than 0 mass % for practical respond. This allows us to reduce the manufacturing cost of the aluminum alloy castings and improves their recyclability.

The Mg content should be 0.1 mass %, preferably 0.15 mass %, or most preferably 0.2 mass % as the lowest limit, and 0.5 mass % or preferably 0.4 mass % as the upper limit. For example, the Mg content should be 0.1-0.5 mass % or preferably 0.2-0.4 mass %.

The aluminum alloys according to the invention essentially do not contain Cu, which is the precipitation strengthening element. Therefore, it is extremely important to contain an appropriate amount of Mg in order to secure the strength and fatigue strength of an aluminum alloy to be used as the base metal of cylinder heads, etc. If the Mg content is too little, the matrix phase becomes too soft and the effect will be insufficient. If the Mg content is too much, the ductility and toughness of the aluminum alloy is reduced and there is a reduction of the thermo-mechanical fatigue resistance.

The preferred amount of Ni is 0.2-3.0 mass %. Ni causes Ni compounds to be crystallized to strengthen the skeleton phase of the network. If the Ni content is less than 0.2 mass %, the amount of Ni compounds generated is too little, and the formation of the network-type skeleton phase consisting of crystallized substances becomes insufficient. When the Ni content exceeds 3.0 mass %, it tends to cause Ni compounds to be coarser and may severely reduce ductility and toughness. In particular, when the Ni content exceeds 2 mass %, Ni compounds begin to be coarser and start to deteriorate the homogeneity of the structure. Therefore, the Ni content should preferably be chosen to be 0.5 to 2.0 mass %, as this assures that the amount and size of crystallized Ni compounds are appropriate and homogenous solidification structures are provided. "Ni compound" is the general name for all compounds that contain Ni. Typical Ni compounds include Al—Ni compounds, Al—Ni—Cu compounds, and Al—Fe—Ni compounds. Moreover, the optimum range of Ni content is 0.7-1.5 mass %. This range of Ni content provides an optimum size and amount of Ni compounds, which results in a stable and high thermo-mechanical fatigue resistance.

The preferable Fe content is 0.1-0.7 mass %. If the Fe content is less than 0.1 mass %, the amount of Fe compounds generated is too little, and the formation of the network-type skeleton phase consisting of crystallized substances becomes insufficient. When the Fe content exceeds 0.7 mass %, it tends to cause Fe compounds to be coarser and may severely reduce ductility and toughness. It is preferable if the Fe content is 0.2-0.6 mass %. The optimum range of Fe content is 0.3-0.5 mass %. This range of Fe content maximizes the abovementioned effect. "Fe compound" is the general name for all compounds that contain Fe. Typical Fe compounds include Al—Si—Fe—Mn compounds, Al—Si—Fe compounds, and Al—Fe—Ni compounds.

The preferable Ti content is 0.15-0.3 mass %. More preferably, Ti content is about 0.2-0.3 mass %. And still more preferably, Ti content is 0.2-0.25 mass %. Ti makes crystal grains finer and strengthens the matrix phase by its solid solution. When the crystal grains become sufficiently finer, the network-type skeleton phase that consists of crystallized substances becomes isotropic. Ti solid solution in the matrix phase make the matrix phase harder, suppress the strain concentrations in the matrix phase, and make the strain distribution more uniform. The stress and strain applied to a casting thus become more uniform, improving its fatigue strength. When the Ti content is less than 0.15 mass %, crystal grains do not become fine enough, and the dendrite structure, which is unique to casting structures, grow easily, thus preventing the development of the isotropic, network-type skeleton phase. When the Ti content exceeds 0.3 mass %, the amount of Ti that makes solid solution increases, causing the matrix to be too hard, and may cause shearing breakdown of the casting. It may also cause coarse Ti compounds to develop in the matrix and may severely reduce the ductility and toughness of the casting.

Ti can be added to an alloy in the last stage of melting raw ingredients by adding Al—Ti alloys, Al—Ti—B alloys, Al—Ti—C alloys, etc. Adding Ti to the base alloy (aluminum alloy) in this manner makes it possible to suppress the agglutination of Ti compounds, facilitates making crystal grains finer, and facilitates making metallic structures more isotropic and uniform. When Al—Ti—B is used as the material for adding Ti, boron (B) exists in the alloy. If the B content increases, the heat resistance of the aluminum alloy deteriorates, so that it is preferable to limit the B content to less than 0.01 mass %.

Incidentally, the ratio between the crystal grain size "d" and the secondary dendrite arm distance DAS, i.e., d/DAS, of the aluminum alloys of the invention is approximately 5-20. This crystal grain diameter "d" can be obtained by a measurement in accordance with the JIS-H-0501 "Rolled Copper Product Grain Size Testing Method", for example.

It is preferable for the aluminum alloys of the invention to contain 0.1-0.7 mass % of manganese (Mn). Mn crystallizes to produce Mn compounds and strengthens the skeleton phase. If the Mn contents is less than 0.1 mass %, the effect is too small. If the Mn contents exceed 0.7 mass %, the Mn compounds tend to be coarser and may severely reduce ductility and toughness. Mn also prevents Fe compounds from becoming too coarse and needle-like which prevents reduction of ductility and toughness. The Mn content should preferably be 0.2-0.5 mass %. The more preferable range is 0.3-0.5 mass %. This range of Fe content maximizes the abovementioned effect. "Mn compound" is the general name for all compounds that contain Mn. Typical Mn compounds include Al—Si—Fe—Mn compounds, Al—Si—Mn compounds, and Al—Mn compounds.

The aluminum compounds of the present invention should preferably include either 0.03-0.5 mass % of zirconium (Zr), 0.02-0.5 mass % of vanadium (V), or both. Both of these elements make the crystal size finer, prevent the alignment of dendrites, and make the network-type skeleton phase of crystallized substances more isotropic. Both of these elements strengthen the matrix by their solid solutions and improve high temperature strength adequately. They also prevent the strain concentrations to the matrix phase. If their contents are too low, their effects will be limited. If their contents are excessive, coarse, primarily solidified compounds will be generated, severely reducing the casting's ductility and toughness. Moreover, if the contents of both elements are excessive, uniform dissolution becomes difficult unless the temperature of the molten metal is raised. If the contents of both elements exceed 0.5 mass %, coarse Ti compounds will develop and may reduce the casting's ductility and toughness and the amount of Ti effective for refining crystal grains mentioned before, thus causing the crystal grains to become too coarse. This could damage the isotropicity and uniformity of the casting's metallic structure. The preferable amount of Zr is 0.03-0.15 mass %, and the preferable amount of V is 0.02-0.15 mass %. It is most preferable if both elements are contained.

The aluminum compounds of the present invention should preferably include 0.0005-0.003 mass % of calcium (Ca). If a minute amount of Ca is added in addition of Ti, Zr or V within the ranges mentioned above, the refining of the crystal grains will be stabilized further. If the Ca content is less than 0.0005 mass %, a sufficient effect cannot be achieved. If the Ca content exceeds 0.003 mass %, dendrite structures tend to develop, which deteriorates the isotropicity of the network-type skeleton phase of crystallized substances, and makes the casting structure heterogeneous. When the Ca content increases, it also tends to increase porosity, which is another casting defect. Therefore the Ca content should be controlled to be less than 0.002 mass %.

(2) Structure

The aluminum alloy castings according to the present invention or castings produced by using the aluminum alloys for casting according to the present invention (collectively "aluminum alloy castings" or "castings") include the matrix phase and the skeleton phase. The matrix phase is mainly α-Al and the skeleton phase is crystallized substances surrounding the matrix phase in a network-shape (FIG. 1). These metallic structures are obtained when the skeleton phase is generated by crystallization according to an eutectic reaction around the matrix phase, for example, after the matrix is primarily solidified. The metallurgical structure becomes mainly a hypoeutectic structure obtained by mushy-type solidification of molten aluminum alloy in a mold.

The matrix phase contains not only α-Al, but also solid solutions of various alloy elements and particles of precipitated compounds (e.g., precipitated particles of Mg compounds) and the like. The skeleton phase also contains not only Al—Si eutectic, but also compounds crystallized together with the eutectic as well as solid solutions of various alloy elements, etc. The compound particles that strengthen the skeleton phase by crystallizing or precipitating in the skeleton phase will be called the "strengthening particles" of the skeleton (see FIG. 1). These strengthening particles include, for example, Al—Ni compounds, Al—Si—Ni compounds, Al—Fe compounds, Al—Si—Fe compounds, Al—Si—Fe—Mn compounds, and eutectic Si. Of these, eutectic particles of Ni compounds and Fe compounds have the strongest effects as the strengthening particles. In addition to these, SiC, $Al_2O_3$, and $TiB_2$ particles can be strengthening particles.

The skeleton phase includes crystallized substances having high elasticity and high yield stress, and hard strengthening particles. These elements are connected in a network shape to surround the matrix phase, and their structure is fine and uniform, so that the stresses applied to the casting are spread out evenly by the skeleton, and the stress burden of the matrix, that could be the source of fatigue fractures, tends to be lowered. It is believed that this is the reason that the fatigue resistance of the aluminum alloy castings such as high-cycle fatigue strength, and thermo-mechanical fatigue resistance are improved.

The aluminum alloy castings according to the present invention should preferably be hypoeutectic structures having no primary Si. In producing large castings of complex shapes having cavities such as cylinder heads, it is difficult to remove porosities from the castings to the heads which are located on the outside of the castings by controlling the orientation of solidification. Therefore, it is possible to mitigate local porosity concentrations if castings of hypoeutectic structures can be achieved, in order to avoid deterioration of the fatigue resistance characteristics due to concentration of porosities in stress concentration areas. The hypoeutectic structure generation also helps even a small amount of crystallized substance generate the skeleton phase efficiently by dispersedly generating the crystallization in a network shape.

The primary Si can be a starting point of a fatigue fracture. In case of a large casting such as a cylinder head, in particular, solidification occurs slowly in general, so that the primary Si generated during the solidification may float up to the top of the molten metal to form a segregation, which can be the starting point of a fatigue fracture. Therefore, it is preferable that essentially no primary Si exists. Since the amount of Si is less than that of the eutectic point of the Al—Si two element alloy, it is relatively difficult to cause the primary Si to be generated. However, depending on alloy elements other than Si and their contents, the eutectic point may shift toward the low Si side to cause the primary Si to be generated. In such a case, it is best to control the Si content within the range of not deteriorating the castability, etc.

The aluminum alloy castings of the invention can be produced by adding elements such as strontium (Sr), sodium (Na), and antimony (Sb) that can make the eutectic Si finer. This improves the ductility and toughness of a casting. The preferable Sr content is 0.003-0.03 mass %. If the Sr content exceeds 0.03 mass %, the refining effect of the eutectic Si particle becomes saturated and also its gas absorption becomes intensified. Also, if the Sr contents is less than 0.003 mass %, the refining effect of the eutectic Si particle becomes insufficient.

The preferable Sb content is 0.02-0.3 mass %. If the Sb content exceeds 0.3 mass %, the fluidity of the molten metal reduces and defects due to insufficient metal flow may occur. If the Sb content is less than 0.02 mass %, the refining effect of the eutectic Si particle becomes insufficient.

The preferable Na content is 0.003-0.03 mass %. If the Na content exceeds 0.03 mass %, a reduction of the toughness may occur. If the Na content is less than 0.003 mass %, the refining effect of the eutectic Si particle becomes insufficient.

If the aluminum alloy castings according to the invention contains an appropriate amount of Mg, not only the above-mentioned skeleton phase but also the matrix phase gets strengthened by precipitates, and secures not only the thermo-mechanical fatigue resistance but also the hardness, strength and fatigue resistance of the base metal. The hardness of the matrix in the early stage of usage is preferably Hv 64 or higher in terms of Vickers hardness, or more preferably 67 Hv. The upper limit of this hardness varies with the Mg content and the heat treatment condition, but generally 100 Hv or thereabout. Incidentally, the term "hardness in the early stage of usage" means the hardness of an aluminum casting before it experiences any thermal history (hardness of the virgin state). The term "hardness in the early stage of usage" means the hardness before the engine is operated for the first time (i.e., before firing it).

If the usage environment of an aluminum casting is relatively low (e.g., lower than 150° C.), or the temperature of a specific part of the casting is low, it is expected to be able to maintain the hardness of the matrix there equal to the above-mentioned hardness. The same tendency applies to the hardness of the entire alloy and the hardness is preferably Hv 97 or higher, or more preferably 105 Hv.

In strengthening the matrix with precipitates of Mg and others, heat treatment can be used effectively. The heat treatment process for aluminum alloy castings can be solution heat treatment and aging (age-hardening) heat treatment. In the solution heat treatment, a casting is quenched with water after maintaining it at a high temperature, to form a supersaturated solid solution. In the aging heat treatment, the casting is maintained at a relatively low temperature to cause its elements that have been solid-soluted in a supersaturated condition to precipitate in order to obtain a highly balanced casting in terms of strength, ductility and toughness having evenly distributed fine precipitates. The corners of the crystallized objects are rounded so that the stress concentration is reduced and an improvement in the practical fatigue resistance can be expected. In case of this invention, these heat treatments cause the Mg content in the matrix phase to be precipitated as compounds (mainly Al—Mg—Si compounds), and the hardness of the matrix phase to be increased appropriately.

Those heat treatment conditions are selected arbitrarily depending on the casting's structure and desired characteristics. Depending on the desired treatment temperature and process time, there can be choices between T6, T4, T5, T7 processes and others. For example, the solution heat treatment can be performed by heating the casting at 450-550° C. for 1 to 10 hours and quenching it. The aging heat treatment can be done by holding the casting at 140-300° C. for 1 to 20 hours.

Moreover, the porosity of the aluminum alloy castings according to this invention is preferably less than 0.3 vol %. If the porosity is higher than 0.3%, the excellent thermo-mechanical fatigue resistance cannot be achieved. A more preferable porosity range is less than 0.1 vol %, and the most preferable porosity range is less than 0.05%. This is due to the fact that a lower porosity provides effectively an inherently superior thermo-mechanical fatigue resistance of the alloy. This porosity requirement is only necessary in those critical areas where the thermo-mechanical fatigue resistance of the alloy is needed. As an example, the valve bridge part of a cylinder head is such an area.

(3) Applications

The aluminum alloys for casting of the present invention can be used naturally as the raw materials for aluminum alloy castings. The form of the aluminum alloys for casting can be arbitrary but is normally in an ingot state.

The aluminum alloy castings of the current invention can have any size and shape, and used in arbitrary environments, but are most suitable for members for which high strength, fatigue resistance and thermo-mechanical fatigue resistance are required simultaneously. For example, they can be components used in engines, motors, and heat radiators. For example, cylinder heads and turbo rotors are the examples of engine components. Because of their high corrosion resistances, the aluminum alloy castings according to the present invention are also suitable for exhaust system components (such as exhaust pipes and exhaust control valves). Moreover, because of excellent fatigue strength and corrosion resistances, the aluminum alloy castings according to the present invention are also suitable for components where those characteristics are required such as underbody components and chassis members, and their use to those components contribute to their weight reduction and performance upgrades. More specifically, some of the underbody components those castings are applicable are disk wheels, upper arms, lower arms, suspension arms, axle carriers, and axle beams. The chassis members to which the castings are applicable are side members and cross members. The castings can be used as various engine components and brackets used for mounting peripheral members as well as transmission cases. The castings can be used not only for automobile components but also any other applications wherever corrosion resistances and fatigue strengths are required and can contribute in weight reductions and performance improvements.

The aluminum alloy castings of the present invention are particularly suited for cylinder heads of reciprocating engines which require hardness and strength as well as thermo-mechanical fatigue strength of the base metal. Cylinder heads are subjected to severe thermal environments and repetitive thermal strains. The materials to be used for valve bridge areas of combustion chambers are particularly required to have extremely high thermo-mechanical fatigue resistance. On the other hand, high strength and high fatigue resistance are required for the base material in other parts. In the water jacket areas, a high corrosion resistance is required in order to suppress the reduction of the thermal conductivity, in other words, the reduction of the cooling efficiency, due to the development of corrosion film, for a long period of time. Cylinder heads made of the aluminum alloys for casting according to the present invention satisfy all of these requirements to a high degree. Moreover, while cylinder heads are generally large in size and complex in shape, the aluminum alloys for casting according to the present invention have excellent castabilities so that they are most suited as their raw material alloys. Furthermore, while cylinder heads are subjected to various machining including cutting and grinding to form assembling surfaces and camshaft bearing surfaces, the aluminum alloys for casting according to the present invention provide no hindrance against those machining processes.

No particular casting method is required for the aluminum alloys for casting according to the present invention. Either sand mold casting, die casting, gravity casting, low pressure casting or high pressure casting can be used. Considering mass production, die casting or low pressure casting are most suitable.

The present invention will be described in more specifically referring to the following examples:

Example 1

(1) Production of Test Pieces

After preparing molten metal by melting various aluminum alloys of different compositions as shown in table 1, it was poured into a mold for preparing the JIS No. 4 test pieces, left for natural cooling and solidification (casting process). The casting thus obtained was then heated at 530° C. for 5.5 hours and water quenched in a warm water of 50° C. as a solution heat treatment. After this treatment, the casting was further subjected to aging by heating at 160° C. for 5 hours. From the heat treated casting, thermo-mechanical fatigue test pieces No. 1-1 through 1-8 each having a parallel area of 4 mm diameter×6 mm length as shown in Table 1 were produced.

(2) Evaluation of Thermo-Mechanical Fatigue Resistance

The thermo-mechanical fatigue resistance of each test piece was evaluated as follows.

Each of the test pieces described above was mounted on the restraint holder made of a low thermal expansion alloy and subjected to a repetitive cycle of heating and cooling. The test temperature range was 50° C.-250° C., the repetition speed was 5 minute/cycle consisting of 2 minutes of heating and 3 minutes of cooling. The details of the thermo-mechanical fatigue test method can be found, for example, in Unexamined Patent Publication H7-20031; "Zairyo (Material)" Vol. 45 (1996), pp. 125-130; and "Keikinzoku (Light Metals)" vol. 45 (1995), pp. 671-676.

The thermo-mechanical fatigue life of each test piece obtained by the abovementioned thermo-mechanical fatigue test is shown in Table 1. The total strain range in the initial period of the test measured by attaching a high temperature strain gauge on the test piece made of the JIS-AC2B aluminum alloy was approximately 0.6%.

Comparing the results of the test pieces shown in Table 1, highly increased thermo-mechanical fatigue lives were found when Cu was maintained less than 0.2 mass % and appropriate amounts of Ni, Fe, Mn and Ti were contained. Further, by comparing the results of the test pieces No. 1-1 through 1-6 with the test piece 1-8, the thermo-mechanical fatigue life extends considerably by containing 0.2-3.0 mass % of Ni when the Cu content is less than 0.2 mass %.

Comparing the test pieces No. 1-1 and 1-5 with the test pieces No. 1-2 and 1-6, the test pieces containing appropriate amounts of Mn, Zr and V have substantially longer lives compared to other test pieces.

Example 2

Test pieces No. 2-1 through 2-6 were prepared as shown in Table 2 using the aluminum alloys for casting of different compositions in a similar manner as in Embodiment No. 1. These test pieces have different amount of Mg.

Hardness of the test pieces was measured and the hardness measurement was conducted using a Vickers Hardness Tester or a Micro Vickers Hardness Tester. The "Total Mean Hardness", shown in Table 2, was measured by creating a large indentation with a load of 10 kgf and a loading time of 30 sec and represents a mean hardness of the entire test piece. The "Initial Hardness of Matrix Phase" was measured by creating a small indentation in the center of the matrix phase with a load of 100 g and a loading time of 30 sec on the test piece prior to heating. The "Hardness of Matrix Phase after Heating" is the hardness of the matrix after heating it at 250° C. for 100 hr and is measured in a similar manner as the "Initial Hardness of Matrix Phase" mentioned above.

As can be seen from Table 2, the entire hardness and the hardness of the matrix phase are particularly higher in the test pieces having an Mg content higher than 0.1 mass %. The "Total Mean Hardness" is not dependent so much on the Mg content and is higher than 100 Hv in the test pieces No. 2-1 through No. 2-3, in which the Mg content exceeds 0.2 mass %.

In contrast, the "Total Mean Hardness" is not dependent on Mg content and is extremely low in the test pieces No. 2-4 and No. 2-5, in which the Mg content is less than 0.1 mass %. Similar tendencies are found in the "Initial Hardness of Matrix Phase" as well.

Consequently, it is believed that castings with an Mg content exceeding 0.2 mass % are suitable for base materials of high strength components of engines such as cylinder heads and exhaust system components as they main high hardness and high strength in areas not subjected to high temperatures.

The "Hardness of Matrix Phase after Heating" is lower compared to the "Initial Hardness of Matrix Phase" prior to heating in all test pieces. The drop is particularly larger in test pieces having the Mg content exceeding 0.2 mass %. However, the "Hardness of Matrix Phase after Heating" is stable regardless of the amount of Mg. Therefore, it is estimated that castings having appropriate amounts of Mg also have sufficiently softened matrices and have improved ductility, as do the alloys having essentially no Mg. In other words, it is estimated that the inclusion of a certain amount of Mg not exceeding 0.5 mass % which is intended to increase the hardness, strength, fatigue strength and other characteristics of the base metal, cannot be a factor in substantially affecting the thermo-mechanical fatigue resistance of the areas exposed to temperatures as high as 250° C. For example, a cylinder head containing 0.2 mass % to 0.5 mass % of Mg is expected to provide excellent thermo-mechanical fatigue resistance in areas exposed to high temperature environment and to maintain high initial strength and other desirable characteristics in the surrounding areas which are exposed to relatively low temperatures.

The aluminum alloys according to the present invention provide such excellent features because of the synergistic effects of appropriate Mg and Ni contents as can be seen from Table 1 and Table 2.

Example 3

Test pieces No. 3-1 through 3-3 were prepared as shown in Table 3 using different compositions of the aluminum alloys for casting as in Example 1. These test pieces have different Cu contents.

A salt water spraying test was applied to these test pieces and the corrosion resistance characteristics of these test pieces are evaluated. The salt water spraying test was conducted in accordance with JIS Z2371-1994 for 100 hours, maintaining the salt water concentration to 5% and the temperature of the spraying salt water to 35° C. The surfaces of the test pieces were polished prior to the test using #600 water resistant grinding paper.

Figure 2A:
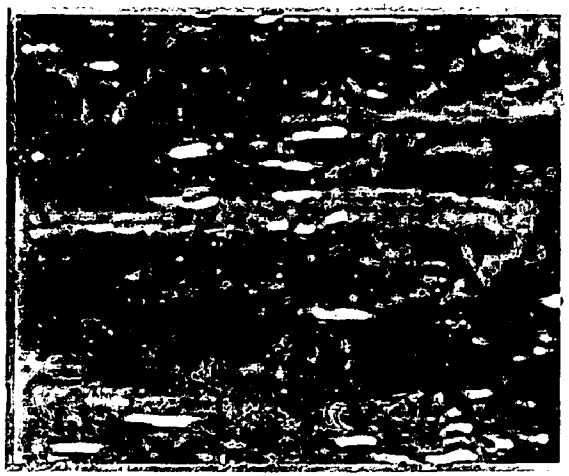
FIGS. 2(*a*)-2(*c*) are photographs showing corrosions of aluminum alloy castings with different Cu contents were subjected to the salt water spray test, where Cu contents are: 2(*a*) 0 mass %, (*b*) 0.5 mass %, and 2(*c*) 5 mass % level upon 100% mass of the alloy.
Figure 2B:
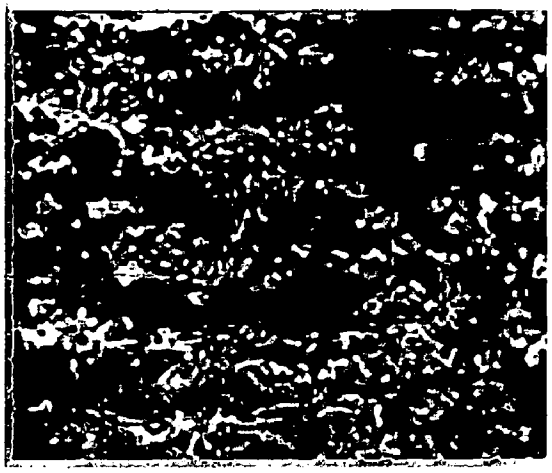
Figure 2C:
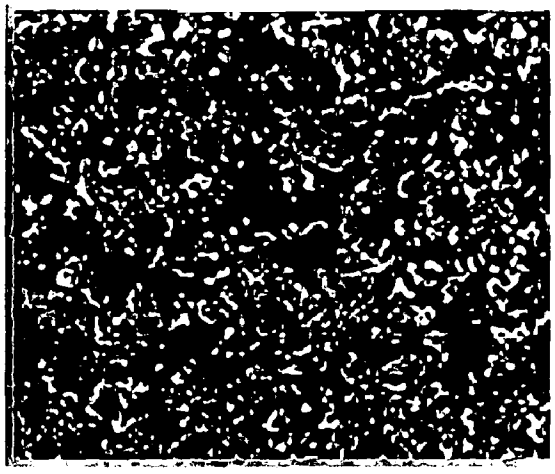

FIGS. 2 (*a*)-2(*c*) show surface photographs of test pieces No. 3-1 through No. 3-3 washed after the salt water spraying test. It can be seen that the test pieces with higher Cu contents are corroded severely, while almost no corrosions exist in the test pieces with low Cu contents. Test piece No. 3-1, which contains less that 0.2 mass % of Cu, seems to have almost no sign of corrosion, indicating that it has a very strong corrosion resistance.

Therefore, cylinder heads, for example, made of the aluminum alloys according to the present invention should have high corrosion resistance in addition to the aforementioned strength and high thermo-mechanical fatigue resistance, providing extremely high reliability.

Example 4

Test pieces No. 4-1 through 4-3 were prepared as shown in Table 4 using different compositions of aluminum alloys for casting as in Example 1. These test pieces have different B contents. These test pieces were heat treated at 150° C. for 100 hours, and then, the Vickers hardness was measured. The results are shown in Table 4. The hardness test was conducted at room temperature.

From the results shown in Table 4, it can be seen that the smaller the B content, the higher the hardness after heating for a long time. Therefore, it is preferable to control the upper limit of B content to less than 0.01 mass % as an impurity.

Example 5

Test pieces No. 5-1 through 5-4 were prepared as shown in Table 5 using different compositions of aluminum alloys for casting as in Example 1. These test pieces have different Ca contents.

The solidification structure of each test piece was observed with an optical microscope. The homogeneity of the structure is indicated by symbols ○, Δ and X. The symbol ○ denotes a case where isotropic network structures having crystallized substances are formed, the symbol X denotes a case where dendrite structures are developed, and the symbol Δ denotes a case where aligned dendrite structures exist in some areas.

Test pieces No. 5-1 and 5-2, with Ca contents of 0.0005-0.003 mass %, are homogeneous structures in which isotropic network-type skeleton phases are formed over the entire test pieces. On the other hand, test piece No. 5-3, with a Ca content of less than 0.0005 mass %, appears to be a slightly heterogeneous structure with some aligned dendrite structures existing in some parts of the structure. The test piece No. 5-4, with a Ca content exceeding 0.003 mass %, is a heterogeneous structure with aligned dendrite structures scattered over the entire area. Therefore, it can be said that it is preferable to control the Ca content to be 0.0005-0.003 mass %.

TABLE 1

| Specimen | Chemical Composition (Mass %) | | | | | | | | | | Thermal Fatigue Life |
|---|---|---|---|---|---|---|---|---|---|---|---|
| No. | Si | Cu | Mg | Ni | Fe | Mn | Ti | Zr | V | Al | (cycles) |
| 1-1 | 7.5 | 0 | 0.3 | 1 | 0.4 | 0.4 | 0.2 | 0.1 | 0.1 | Remainder | 6400 |
| 1-2 | 7.5 | 0 | 0.3 | 1 | 0.4 | 0 | 0.2 | 0.1 | 0.1 | Remainder | 6000 |
| 1-3 | 7.5 | 0.2 | 0.3 | 1 | 0.4 | 0.4 | 0.2 | 0.1 | 0.1 | Remainder | 5200 |
| 1-4 | 7.5 | 0 | 0.3 | 0.2 | 0.4 | 0.4 | 0.2 | 0.1 | 0.1 | Remainder | 4900 |
| 1-5 | 7.5 | 0 | 0.3 | 3 | 0.4 | 0.4 | 0.2 | 0.1 | 0.1 | Remainder | 6500 |
| 1-6 | 7.5 | 0 | 0.3 | 1 | 0.4 | 0.4 | 0.2 | 0 | 0 | Remainder | 4800 |
| 1-7 | 7.0 | 0.8 | 0.3 | 0 | 0.1 | 0 | 0 | 0 | 0 | Remainder | 1400 |
| 1-8 | 7.5 | 0 | 0.3 | 0 | 0.4 | 0.3 | 0.2 | 0 | 0 | Remainder | 2800 |

TABLE 2

| Specimen | Chemical Composition (Mass %) | | | | | | | | | | Total Mean Hardness | Initial Hardness of | Hardness of Matrix Phase After Heating (HV) |
|---|---|---|---|---|---|---|---|---|---|---|---|---|---|
| No. | Si | Cu | Mg | Ni | Fe | Mn | Ti | Zr | V | Al | (HV) | Matrix Phase | (250° C. × 100 hr) |
| 2-1 | 7.5 | 0 | 025 | 1 | 0.4 | 0.4 | 0.2 | 0.1 | 0.1 | Remainder | 105 | 67 | 37 |
| 2-2 | 7.5 | 0 | 0.3 | 1 | 0.4 | 0.4 | 0.2 | 0.1 | 0.1 | Remainder | 115 | 76 | 40 |
| 2-3 | 7.5 | 0 | 0.5 | 1 | 0.4 | 0.4 | 0.2 | 0.1 | 0.1 | Remainder | 126 | 85 | 35 |
| 2-4 | 7.5 | 0 | 0 | 1 | 0.4 | 0.4 | 0.2 | 0.1 | 0.1 | Remainder | 60 | 43 | 42 |
| 2-5 | 7.5 | 0 | 0.1 | 1 | 0.4 | 0.4 | 0.2 | 0.1 | 0.1 | Remainder | 62 | 45 | 41 |
| 2-6 | 7.5 | 0 | 0.2 | 1 | 0.4 | 0.4 | 0.2 | 0.1 | 0.1 | Remainder | 96 | 63 | 38 |

TABLE 3

| Specimen | Chemical Composition (Mass %) | | | | | | | | | | Corrosion | |
|---|---|---|---|---|---|---|---|---|---|---|---|---|
| No. | Si | Cu | Mg | Ni | Fe | Mn | Ti | Zr | V | Al | Resistance | Corrosion State |
| 3-1 | 7.5 | 0 | 0.3 | 1 | 0.4 | 0.4 | 0.2 | 0.1 | 0.1 | Remainder | ◎ | No corrosion |
| 3-2 | 6 | 0.5 | 0.3 | 0 | 0.1 | 0 | 0 | | 0 | Remainder | Δ | Corrosion preventive surface |
| 3-3 | 6 | 5 | 0.3 | 0 | 0.1 | 0 | 0 | 0 | 0 | Remainder | X | Extremely corrosion |

TABLE 4

| Specimen | Chemical Composition (Mass %) | | | | | | | | | | | Room Temperature Thickness After Heating (HV) |
|---|---|---|---|---|---|---|---|---|---|---|---|---|
| No. | Si | Cu | Mg | Ni | Fe | Mn | Ti | Zr | V | B | Al | (150° C. × 100 hr) |
| 4-1 | 7.5 | 0 | 03 | 1 | 0.4 | 0.4 | 0.2 | 0.1 | 0.1 | 0 | Remainder | 116 |
| 4-2 | 7.5 | 0 | 0.3 | 1 | 0.4 | 0.4 | 0.2 | 0.1 | 0.1 | 0.008 | Remainder | 114 |
| 4-3 | 7.5 | 0 | 0.3 | 1 | 0.4 | 0.4 | 0.2 | 0.1 | 0.1 | 0.04 | Remainder | 108 |

TABLE 5

| Specimen | Chemical Composition (Mass %) | | | | | | | | | | | Metallographical |
|---|---|---|---|---|---|---|---|---|---|---|---|---|
| No. | Si | Cu | Mg | Ni | Fe | Mn | Ti | Zr | V | Ca | Al | Homogeneity |
| 5-1 | 7.5 | 0 | 0.3 | 1 | 0.4 | 0.4 | 0.2 | 0.1 | 0.1 | 0.001 | Remainder | ○ |
| 5-2 | 7.5 | 0 | 0.3 | 1 | 0.4 | 0.4 | 0.2 | 0.1 | 0.1 | 0.003 | Remainder | ○ |
| 5-3 | 7.5 | 0 | 0.3 | 1 | 0.4 | 0.4 | 0.2 | 0.1 | 0.1 | 0.0002 | Remainder | Δ |
| 5-4 | 7.5 | 0 | 0.3 | 1 | 0.4 | 0.4 | 0.2 | 0.1 | 0.1 | 0.005 | Remainder | X |

What is claimed is:

1. An aluminum alloy for casting consisting of, based upon 100 mass %: 5-9 mass % of silicon (Si), more than or equal to 0.25 and less than or equal to 0.5 mass % of magnesium (Mg), 0.7-1.5 mass % of nickel (Ni), 0.1-0.7 mass % of iron (Fe), from greater than 0.15 to 0.3 mass % of titanium (Ti), less than 0.01 mass % of boron (B), optionally 0.1-0.5 mass % of manganese (Mn), optionally 0.03-0.5 mass % of zirconium (Zr) and/or 0.02-0.5 mass % of vanadium (V), 0.0005-0.003 mass % of calcium (Ca), and the balance being aluminum (Al), wherein Cu is not present in the alloy, or is present only as an inevitable impurity in an amount not to exceed 0.1 mass % of the aluminum alloy, and additional non-metals are only present as inevitable impurities.

2. The aluminum alloy as defined in claim 1, wherein: 0.1-0.5 mass % of manganese (Mn) is present.

3. The aluminum alloy as defined in claim 1, wherein: 0.03-0.5 mass % of zirconium (Zr) and/or 0.02-0.5 mass % of vanadium (V) is/are present.

4. The aluminum alloy as defined in claim 1, wherein the initial hardness of a matrix phase comprising α-Al when in use is higher than 67 Hv in Vickers hardness.

5. The aluminum alloy as defined in claim 1, wherein a metallographic structure, which comprises a matrix phase comprising α-Al and a skeleton phase crystallizing around said matrix phase in a network shape, does not contain primary Si.

6. A casting comprising an aluminum alloy as defined in claim 1.

7. An engine component comprising the casting as defined in claim 6.

8. A cylinder head of a reciprocating engine comprising the casting as defined in claim 6.

* * * * *